US012070829B2

(12) United States Patent
Eto

(10) Patent No.: US 12,070,829 B2
(45) Date of Patent: Aug. 27, 2024

(54) ELECTRIC GRINDING MACHINE

(71) Applicant: NAKAYA CO LTD., Niigata (JP)

(72) Inventor: Naoya Eto, Niigata (JP)

( * ) Notice: Subject to any disclaimer, the term of this patent is extended or adjusted under 35 U.S.C. 154(b) by 825 days.

(21) Appl. No.: 17/097,035

(22) Filed: Nov. 13, 2020

(65) Prior Publication Data

US 2021/0060722 A1 Mar. 4, 2021

Related U.S. Application Data

(63) Continuation of application No. PCT/JP2019/042757, filed on Oct. 31, 2019.

(30) Foreign Application Priority Data

Nov. 2, 2018 (JP) ..... 2018-217744

(51) Int. Cl.
*B24B 23/02* (2006.01)
*B24B 55/05* (2006.01)
*B24B 55/10* (2006.01)

(52) U.S. Cl.
CPC ..... *B24B 23/02* (2013.01); *B24B 55/05* (2013.01); *B24B 55/102* (2013.01)

(58) Field of Classification Search
CPC ..... B24B 23/02; B24B 55/05; B24B 55/10; B24B 23/028; B24B 55/052; B24B 7/186; B23Q 11/08
(Continued)

(56) References Cited

U.S. PATENT DOCUMENTS 3,177,909 A * 4/1965 Laube ..... B27G 19/04 30/391
3,673,744 A * 7/1972 Oimoen ..... B24B 55/102 451/353
(Continued)

FOREIGN PATENT DOCUMENTS

CH 692547 A5 * 7/2002 ..... B23Q 11/08
DE 102006041671 A1 * 3/2008 ..... B24B 23/02
(Continued)

OTHER PUBLICATIONS

Translation of DE-102006041671-B4 (Year: 2024).*
(Continued)

*Primary Examiner* — Brian D Keller
*Assistant Examiner* — Sarah Akyaa Fordjour
(74) *Attorney, Agent, or Firm* — SOEI PATENT & LAW FIRM

(57) ABSTRACT

An electric grinding machine includes a spindle to be driven with a motor; a grinding disc attached to the spindle; a cover covering the grinding disc; a window disposed on the cover to expose an outer circumference of the grinding disc; a hinge mechanism joining the window to the cover so that the window freely moves between an opened position and a closed position, said hinge mechanism having a rotational axis disposed on the cover; a gate protruding from the window and having a cylindrical portion concentrical to the rotational axes; a hollowed portion formed in the gate, said hollowed portion forming a passage opening between the cover and the cylindrical portion when the window is closed; a slider disposed on the cover, said slider passes through the passage opening to hold the window in the closed position; and a piston spring urging the slider toward the window.

14 Claims, 13 Drawing Sheets

(58) Field of Classification Search
USPC ..... 451/451, 456
See application file for complete search history.

(56) References Cited

U.S. PATENT DOCUMENTS

| | | | | |
|---|---|---|---|---|
| 5,125,190 | A * | 6/1992 | Buser | B24B 55/102 451/359 |
| 8,133,094 | B2 | 3/2012 | Lovelss et al. | |
| 8,523,637 | B2 | 9/2013 | Loveless et al. | |
| 9,289,879 | B2 | 3/2016 | Copeland et al. | |
| 2011/0275293 | A1 | 11/2011 | Eto et al. | |
| 2014/0329447 | A1* | 11/2014 | Copeland | E05D 7/00 16/303 |
| 2014/0342645 | A1* | 11/2014 | Tagscherer | B24B 55/052 451/451 |
| 2017/0072532 | A1 | 3/2017 | Kawakami et al. | |
| 2017/0165808 | A1 | 6/2017 | Buser | |

FOREIGN PATENT DOCUMENTS

| | | | | |
|---|---|---|---|---|
| DE | 102008046948 | A1 | 3/2010 | |
| DE | 102006041671 | B4 * | 3/2018 | B24B 23/02 |
| JP | 4710035 | B2 | 4/2011 | |
| JP | 2017-52061 | A | 3/2017 | |
| KR | 10-2015-0025559 | A | 3/2015 | |

OTHER PUBLICATIONS

Translation of CH-692547-A5 (Year: 2024).*
Translation of DE_102006041671_A1 (Year: 2024).*
International Search Report for PCT/JP2019/042757 issued by ISA/JPO on Jan. 28, 2020.

* cited by examiner

ELECTRIC GRINDING MACHINE

CROSS-REFERENCE TO RELATED APPLICATIONS

This is a continuation application of a prior PCT application No. PCT/JP/2019/042757 filed on Oct. 31, 2019.

BACKGROUND OF THE INVENTION AND RELATED ART STATEMENT

The present invention relates to an electric grinding machine having a dust control function. More specifically, the present invention relates to an electric grinding machine capable of preventing dust from scattering and of collecting dust generated when the electric grinding machine is used for grinding concrete and/or stone materials.

When an electric tool such as an electric grinding machine with a grinding disc attached thereto is used for grinding concrete and/or stone materials, it is difficult to avoid generation of dust. To this end, various conventional electric grinding machines have been developed to collect dust.

One of the conventional electric grinding machines includes a bowl shape cover being attached over a grinding disc and a dust collector being connected to a dust-exhaust duct provided on a part of the bowl shape cover, so that dust inside the bowl shape cover is collected through the dust-exhaust duct with a suction force.

According to the conventional electric grinding machine equipped with the dust-control function having the above-described configuration, a whole circumference of the grinding disc is covered with the bowl shape cover. Therefore, it is difficult to grind a corner edge portion near a wall.

To this end, Patent Reference 1 has disclosed an improved conventional electric grinding machine. In the conventional electric grinding machine described in Patent Reference 1, a part of a cover is formed in a sub-cover as a separate component, and the sub-cover is configured to be freely attachable/detachable to the cover. As a result, it is possible to partially expose an outer circumference of the grinding disc. Since the grinding disc is exposed in this way, it is possible to grind a corner edge portion near a wall.

In the conventional electric grinding machine described in Patent Reference 1, however, when the sub-cover is attached or detached to or from the cover, it is necessary to insert or remove a screw each time, thereby reducing work efficiency.

To this end, Patent Reference 2 has disclosed another conventional electric grinding machine. In the conventional electric grinding machine described in Patent Reference 2, similar to the conventional electric grinding machine described in Patent Reference 1, a part of a cover formed in a hatch as a separate component. The hatch is configured as a plug-in type to be attachable and detachable relative to the cover. Therefore, it is not possible to grind a corner edge portion near a wall without inserting or removing a screw.

In the conventional electric grinding machine described in Patent Reference 2, however, it is necessary to fit the hatch to the cover as tight as possible without displacement so that the hatch does not inadvertently come off from the cover. Therefore, when even a slight amount of dust is stick to a plug-in opening of the cover, it is difficult to smoothly attach and detach the hatch due to friction, thereby making it difficult to completely resolve the above-described problem.

To this end, Patent Reference 3 has disclosed still another conventional electric grinding machine. In the conventional electric grinding machine described in Patent Reference 3, a part of a cover is formed in a hatch as a separate component similar to the conventional electric grinding machine described in Patent Reference 2. The hatch is configured to be freely rotational along an outer circumference of the cover, so that the hatch can be easily opened and closed. However, as a result, dust tends to accumulate where the cover and the hatch overlaps, thereby increasing friction between the cover and the hatch. Therefore, it is still difficult to smoothly open and close the hatch.

To this end, Patent Reference 4 has disclosed still another conventional electric grinding machine. In the conventional electric grinding machine described in Patent Reference 4, a part of a cover is formed in a shroud door as a separate component similar to the conventional electric grinding machine described in Patent Reference 3. The shroud door is joined to the cover using a hinge mechanism to be freely rotatable, thereby reducing dust to improve the operativity of opening/closing the shroud door.

In the conventional electric grinding machine described in Patent Reference 4, the shroud door is just temporarily secured to the cover at an opening/closing position thereof with the hinge mechanism. However, when an external load is applied to the shroud door, the shroud door may easily move. Therefore, when the shroud door is caught by an edge of a material, a protrusion on the surface, or the like, the shroud door can be accidentally opened. When the shroud door is left incompletely closed, a suction force for collecting dust inside the cover tends to drop, thereby making it difficult to fully collect dust.

Patent Reference 1: Japanese Patent Publication No. 4710035

Patent Reference 2: U.S. Pat. No. 8,133,094

Patent Reference 3: U.S. Pat. No. 8,523,637

Patent Reference 4: U.S. Pat. No. 9,289,879

As described above, in the conventional electric grinding machines with a dust control function, it is difficult to improve work efficiency at the time of grinding near the wall.

Therefore, an object of the present invention is to provide an electric grinding machine with a dust-control function. In the electric grinding machine of the present invention, a window is disposed on a cover. The window is configured to easily open/close to expose a part of an outer circumference of a grinding disc. Accordingly, it is possible to easily collect dust with high work efficiency even after a number of uses.

SUMMARY OF THE INVENTION

In order to attain the objects described above, according to a first aspect of the present invention, an electric grinding machine is equipped with a dust control function. The electric grinding machine includes a spindle 1 to be driven with a motor; a grinding disc 4 attached to the spindle 1; a cover 8 covering the grinding disc 4; a window 6 disposed on the cover 8 to expose a part of an outer circumference of the grinding disc 4; and a hinge mechanism 7 to join the window 6 to the cover 8 so that the window 6 is freely opened and closed. The hinge mechanism 7 is configured so that a rotational axis thereof is disposed on the cover 8.

Further, according to the first aspect of the invention, the electric grinding machine includes a gate 34 having a cylindrical portion 33. The gate 34 is provided to protrude from the window 6. The cylindrical portion 33 of the gate 34 is provided to be concentrical to the rotational axes of the hinge mechanism 7. Further, the electric grinding machine includes a hollowed portion 36 formed in a part of the gate 34. The hollowed portion 36 constitutes a passage opening 35 between an upper surface of the cover 8 and the cylindrical portion 33. The passage opening 35 is formed to be horizontal to an upper surface of the cover 8 when the window 6 is completely closed. Further, the electrical grinding machine includes a slider 39 disposed on the upper surface of the cover 8. The slider 39 is urged by a piston spring 45 to always protrude toward the window 6 and can slide on the upper surface of the window 6. An end of the slider 39 penetrates the passage opening 35. The electric grinding machine further includes a torsion spring 47 disposed around the rotational axes of the hinge mechanism 7. The torsion spring 47 is configured to urge the window 6 in a direction to be opened all the time.

According to the electric grinding machine equipped with a dust control function of the invention, the slider 39 is configured to hold the upper surface of the window 6. When the slider 39 is pulled toward the cover 8, the window 6 can be automatically opened. Once the window 6 is manually closed, the slider 39 automatically returns to the original position and holds the upper surface of the window 6 again. Therefore, it is easy to switch between closing the window 6 for regular grinding work and opening the window 6 for grinding work near a wall without reducing the work efficiency. In addition, the window 6 can be opened/closed through a rotation thereof around the hinge mechanism 7. Therefore, even when dust adheres to the window 6 after a number of uses, it is possible to easily maintain the smooth operation.

DETAILED DESCRIPTION OF PREFERRED EMBODIMENTS

Hereunder, referring to the accompanying drawings, basic configuration of an electric grinding machine equipped with a dust control function will be fully described based on embodiments of the present invention.

Figure 1:
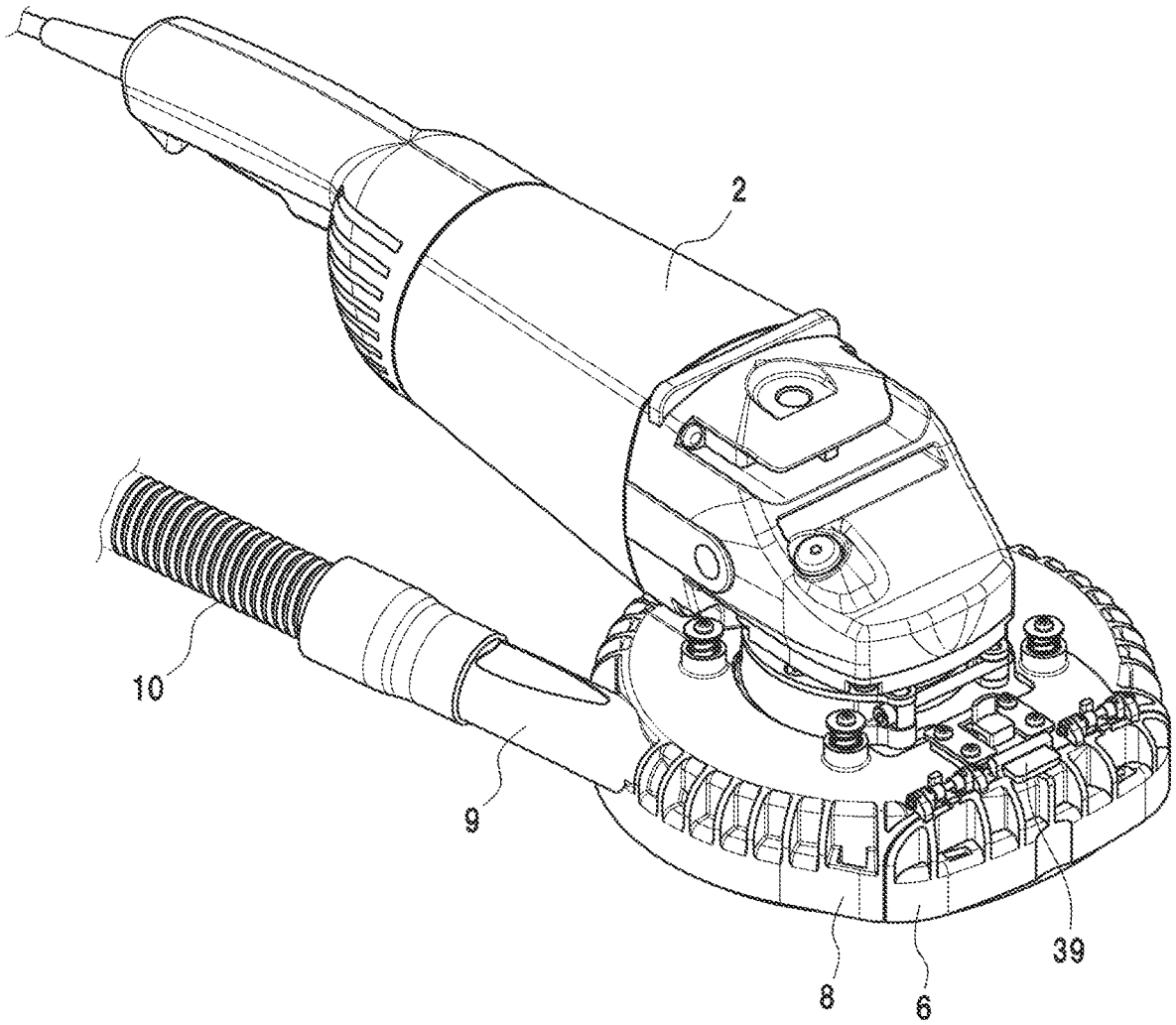
FIG. 1 is a perspective view showing a whole configuration of an electric grinding machine equipped with a dust control function according to a first embodiment of the present invention.
Figure 2:
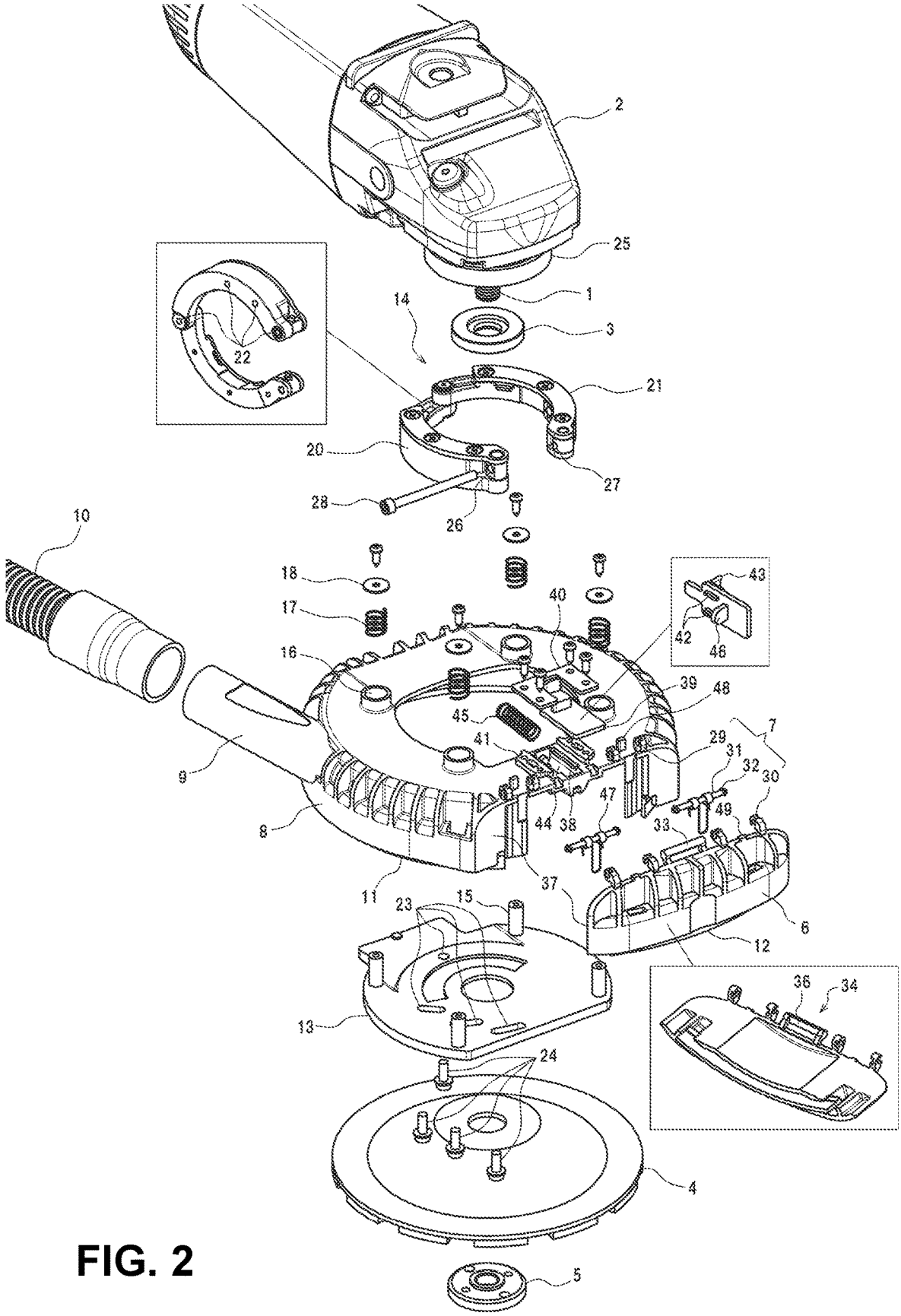
FIG. 2 is a perspective development view showing the whole configuration of the electric grinding machine equipped with a dust control function according to the first embodiment of the present invention.

FIG. 1 is a perspective view showing a whole configuration of an electric grinding machine equipped with a dust control function according to a first embodiment of the present invention. FIG. 2 is a perspective development view showing the whole configuration of the electric grinding machine equipped with a dust control function according to the first embodiment of the present invention.

As shown in FIGS. 1 and 2, according to a first embodiment of the invention, the electric grinding machine equipped with a dust control function includes a grinder main body 2 having a spindle 1; a flange 3 to fit the spindle 1 therein; a grinding disc 4 onto which the flange 3 is placed, a lock nut 5 to fit to screw in the threaded portion of the spindle 1 from the grinding surface side of the grinding disc 4; and a window 6 to expose a part of the outer circumference of the grinding disc 4; and a cover 8 to which the window 6 is joined with hinge mechanisms 7 to be openable/closable. Here, the spindle 1 is driven to rotate with a motor (not illustrated).

On the cover 8, a dust exhausting duct 9 is provided to protrude from the inside to outside of the cover 8. Joining a dust collector 10 to the dust exhausting duct 9, dust generated inside the cover 8 will be collected by suctioning force of the dust collector during grinding work.

In addition, to enable smooth work even during grinding a rough surface, there are provided a first channel brush 11 and a second channel brush 12 on the bottom surfaces of the cover 8 and the window 6.

The grinder 2 and the cover 8 are connected via a base plate 13 and an adapter 14.

Figure 3:
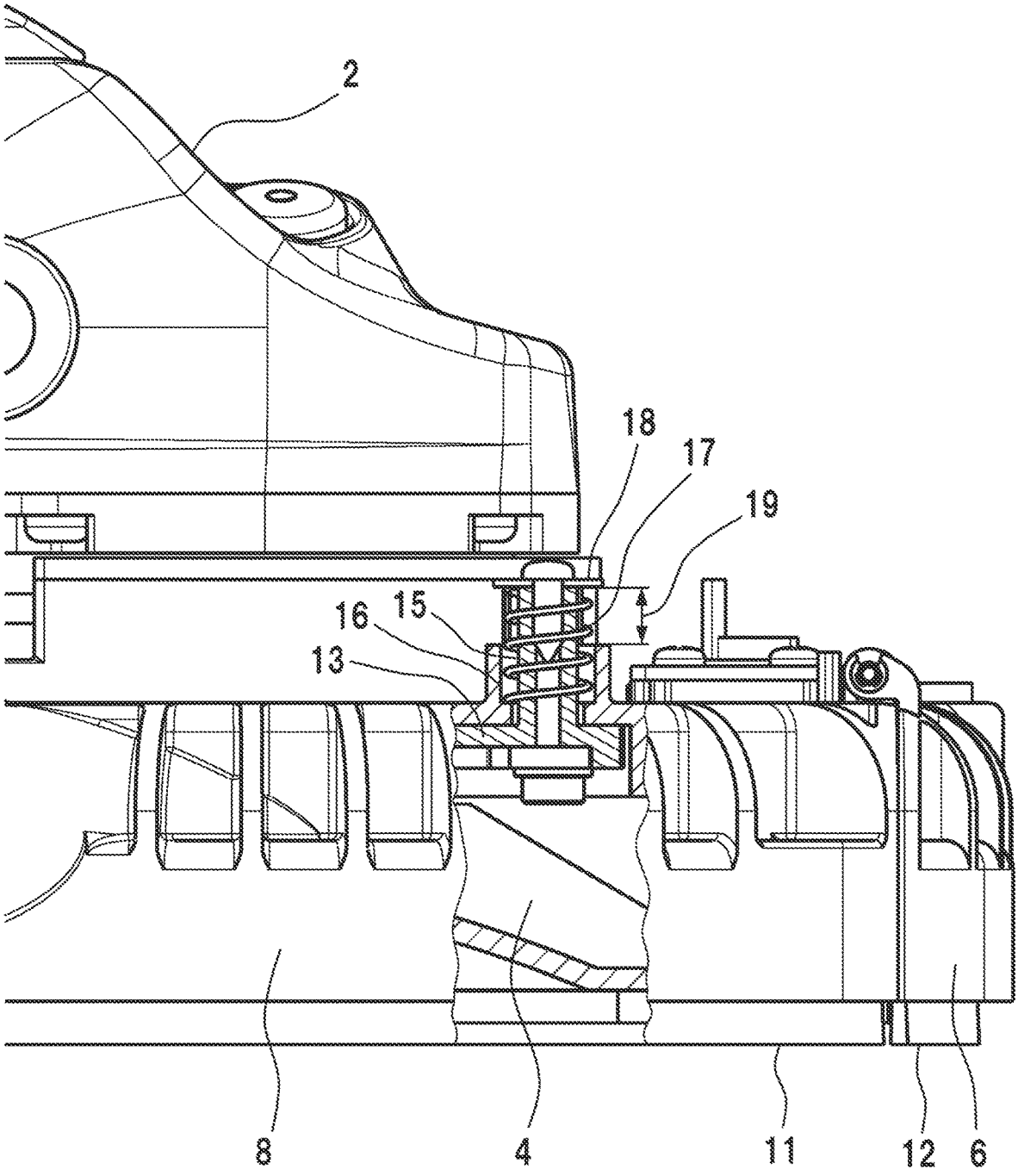
FIG. 3 is a side view including a partial sectional view showing the electric grinding machine equipped with a dust control function in a state when a base plate 13 is held according to the first embodiment of the present invention.

On the base plate 13, there are provided four pillars 15 so as to protrude upward therefrom as shown in FIG. 2. Each of the pillars 15 is fit in a holding hole 16 provided on the cover 8. While placing holding springs 17 between the outer circumference of the pillars 15 and inner circumference of the holding holes 16, holding washers 18 are secured with screws to upper end surfaces of the pillars 15. As a result, the base plate 13 is always pressed to be held onto the inner upper surface of the cover 8 by action of the holding springs 17. FIG. 3 is a side view including a partial sectional view showing the electric grinding machine equipped with a dust control function in a state when a base plate 13 is held according to the first embodiment of the present invention. In the state that the base plate 13 is pressed to be held onto the inner upper surface of the cover 8 by action of the holding springs 17, if load is applied in a direction of grinding surface, the base plate 13 can be moved within the range of a space 19 between the holding washers 18 and the upper end surfaces of the pillars 15 shown in FIG. 3.

As shown in FIG. 2, the adapter 14 includes a first hook 20 and a second hook 21. The first hook 20 and the second hook 21 are both formed to have C shapes, and are joined at each of one end to make the adapter 14 be openable/closable at their free ends. The adapter 14 is secured on the base plate 13 by screwing joining bolts 24 in joining threaded holes 22, which are provided as through holes on the base plate 13.

In the electric grinding machine of the invention, a gear case 25 is provided between a grinder main body 2 and the flange 3. The gear case radially supports the spindle 1 of the grinder main body 2 from the outer circumference thereof, while having the spindle 1 protrude from the gear case 25.

The first hook 20 and the second hook 21 tightly clamp the outer circumference of the gear case 25. From a bolt hole 26 provided on a side surface of the free end of the first hook 20, a holding bolt 28 is inserted to screw in the holding threaded hole 27. As a result, the cover 8 is attached to the grinder main body 2.

Each of the hinge mechanisms 7 includes bearings 29 provided on an upper surface of the cover 8; bearing arms 30 protruding from an upper surface of the window 6 to tightly hold the bearings 29; shaft 31 provided to penetrate the bearings 29 and the bearing arms 30; and stopper rings 32 provided on the both ends of the shaft 31 to prevent the shaft from coming off therefrom.

Here, the hinge mechanisms 7 are provided to be laterally symmetrical when viewed from the front side of the window 8.

Figure 4:
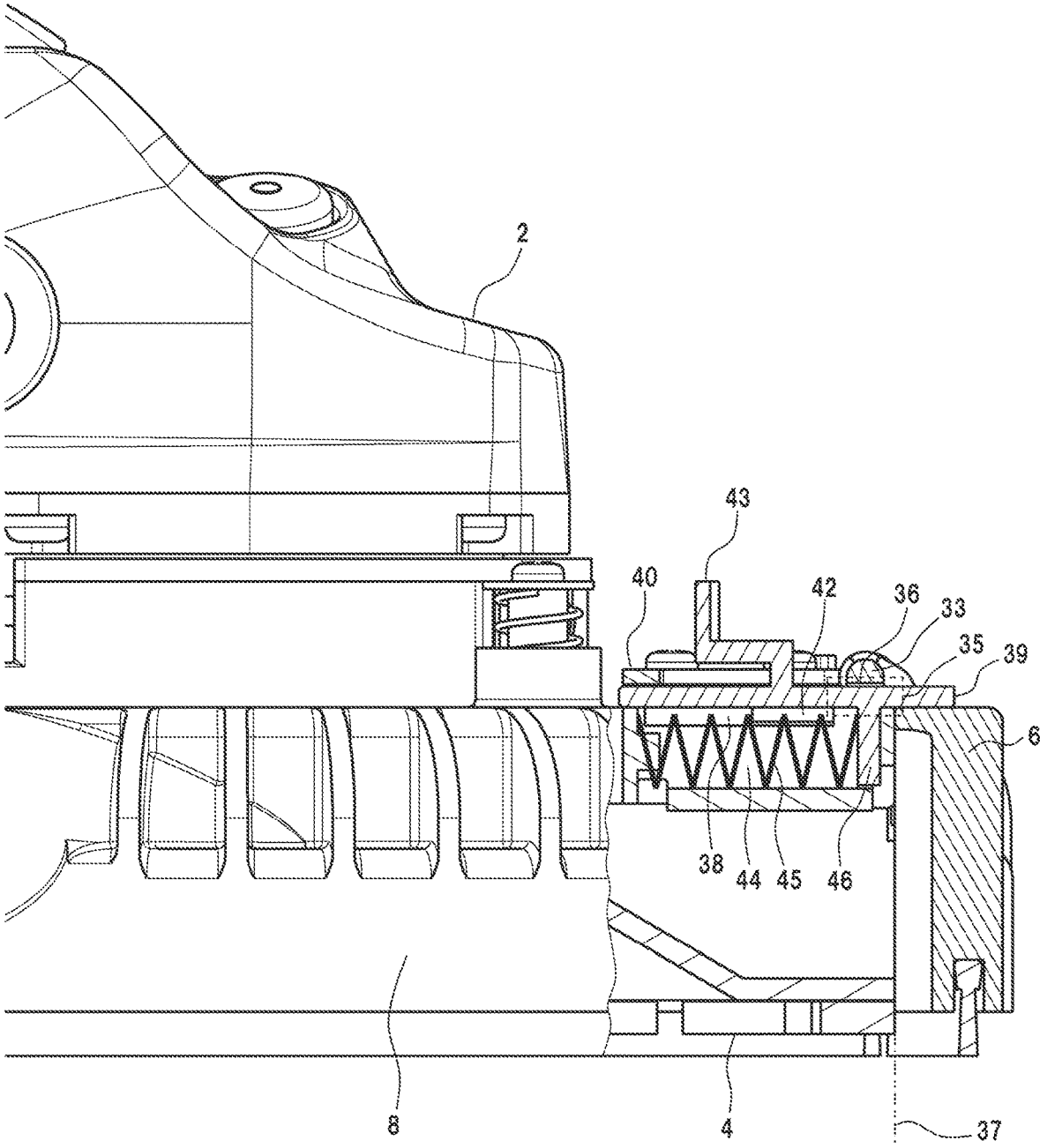
FIG. 4 is a side view including a partial sectional view showing the electric grinding machine equipped with a dust control function in a state when a window 6 is closed according to the first embodiment of the present invention.

The window 6 has a gate 34, which includes a cylindrical portion 33 that is coaxially provided to a rotational axis of the shaft 31. The gate 34 is provided to protrude from the center on the front side of the window 6, which is between the two hinge mechanisms 7. FIG. 4 is a side view including a partial sectional view showing the electric grinding machine equipped with a dust control function in a state when a window 6 is closed according to the first embodiment of the present invention. As shown in FIG. 4, on a part of the gate 34, a hollowed portion is provided between the upper surface of the cover 8 and the cylindrical portion 33, forming passage opening 35 that is horizontal to the upper surface of the cover 8.

On the upper surface of the cover 8, two guide grooves 38 are provided, which are concave along a perpendicular direction to the fitting surfaces of the cover 8 and the window 6. On the guide grooves 38, a slider 39 is to be mounted.

The slider 39 is secured on the cover 88 with a plate 40 from above and a fitting base 41 provided on the upper surface of the cover 8 with screws. At this time, an upper surface of the fitting base 41 is slightly upward than the upper surface of the slider 39. Therefore, the slider 39 is movably placed therein.

On the bottom surface of the slider 39, two elongated guides 42 are provided to project therefrom to fit onto the guide grooves 38. As a result, the slider 39 is held thereon to be linearly movable in a direction perpendicular to the fitting surfaces in the range where the both side surfaces of the guides 42 slide on the both side surfaces of the guide grooves 38.

On the upper surface of the slider 39, there is provided a flat projection 43. The plate 40 is generally formed as a C shape, not to touch the flat projection 43 in the range of linear sliding motion of the slider 39.

On the upper surface of the cover 8, a pocket 44 is formed between the two guide grooves 38, being concave in a direction perpendicular to the fitting surfaces 37.

In the pocket 44, a piston spring 45 is placed in. One end of the piston spring 45 urges a stay 46 protruding from the bottom surface of the slider 39 from the cover 8 side to the window 8 side.

Accordingly, in a state the window 6 is completely closed, the slider 39 is moved to the window 6 side by the action of the piston spring 45. Then, the end of the slider 39 moves to penetrate the passage opening 35 and then reaches the end of the movable range by sliding on the upper surface of the window 6.

At this time, the window 6 is in a non-openable state, being securely held at the cover 8 side by the action of the slider 39.

On the other hand, on the shafts 31 of the hinge mechanisms 7, there are provided torsion springs 47 to surround the shafts 31. The torsion springs 47 urge the window 6 in a direction to keep the window 6 open all the time.

Figure 5:
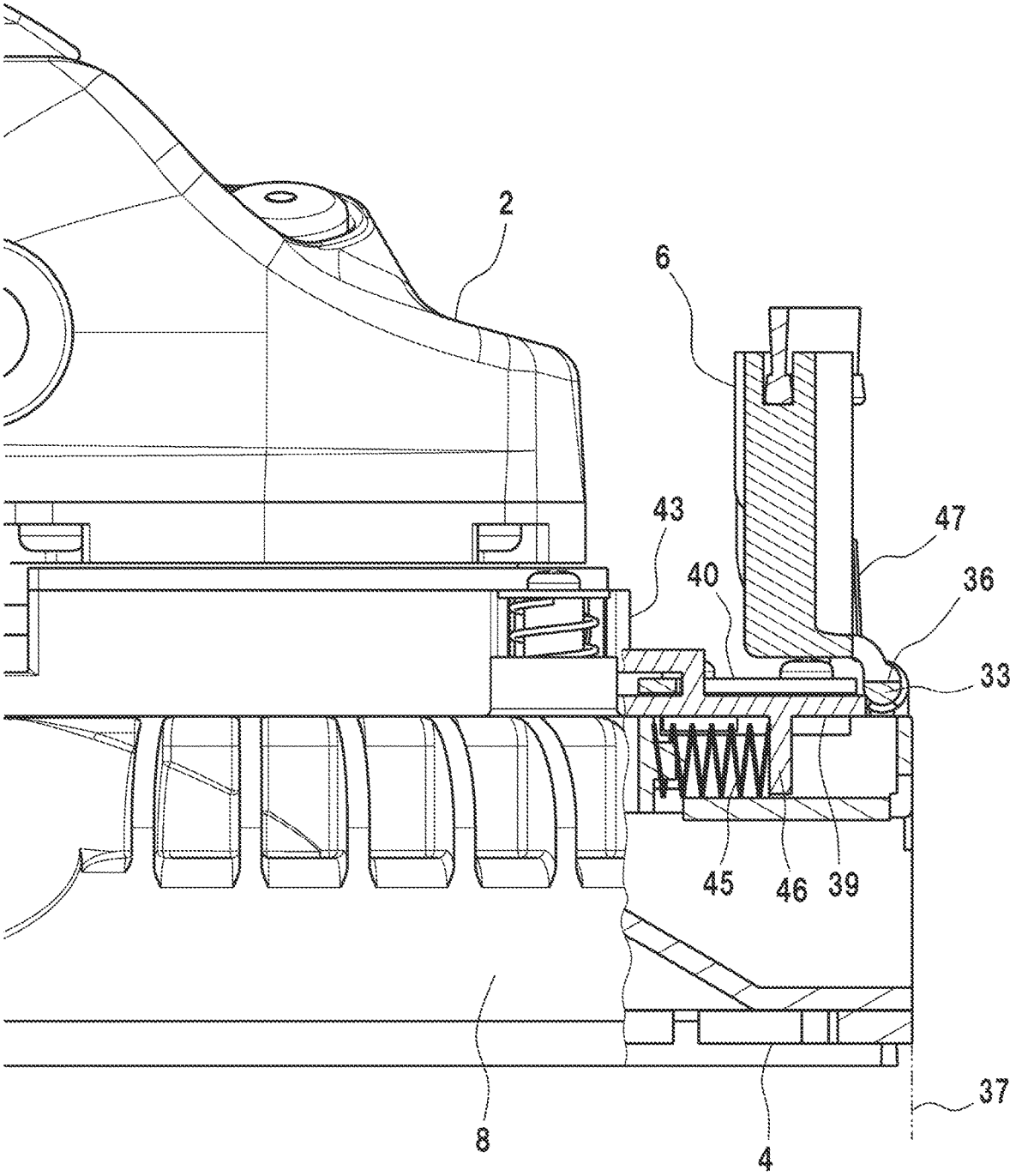
FIG. 5 is a side view including a partial sectional view showing the electric grinding machine equipped with a dust control function in a state when the window 6 is opened according to the first embodiment of the present invention.

FIG. 5 is a side view including a partial sectional view showing the electric grinding machine equipped with a dust control function in a state when the window 6 is opened according to the first embodiment of the present invention. As shown in FIG. 5, once the slider 39 is pulled with the flat projection 43 to the cover 8 side, the window 6 automatically opens by the action of the torsion springs 47 once the end of the slider 39 passes through the passage opening 35.

Here, at the time of rotation of about 180°, the first stopper 48 abuts the second stopper 49 provided on the upper surface of the window 6 to stop the window 6.

At this time, releasing fingers from the flat projection, 43, the slider 39 may move towards the window 6 by the action of the piston spring 45. However, since the hollowed portion 36 of the cylindrical portion 33 also rotated by about 180°, there is no passage opening 38 and the end of the slider 39 touches the outer circumference of the cylindrical portion 33 to lock on.

Figure 6:
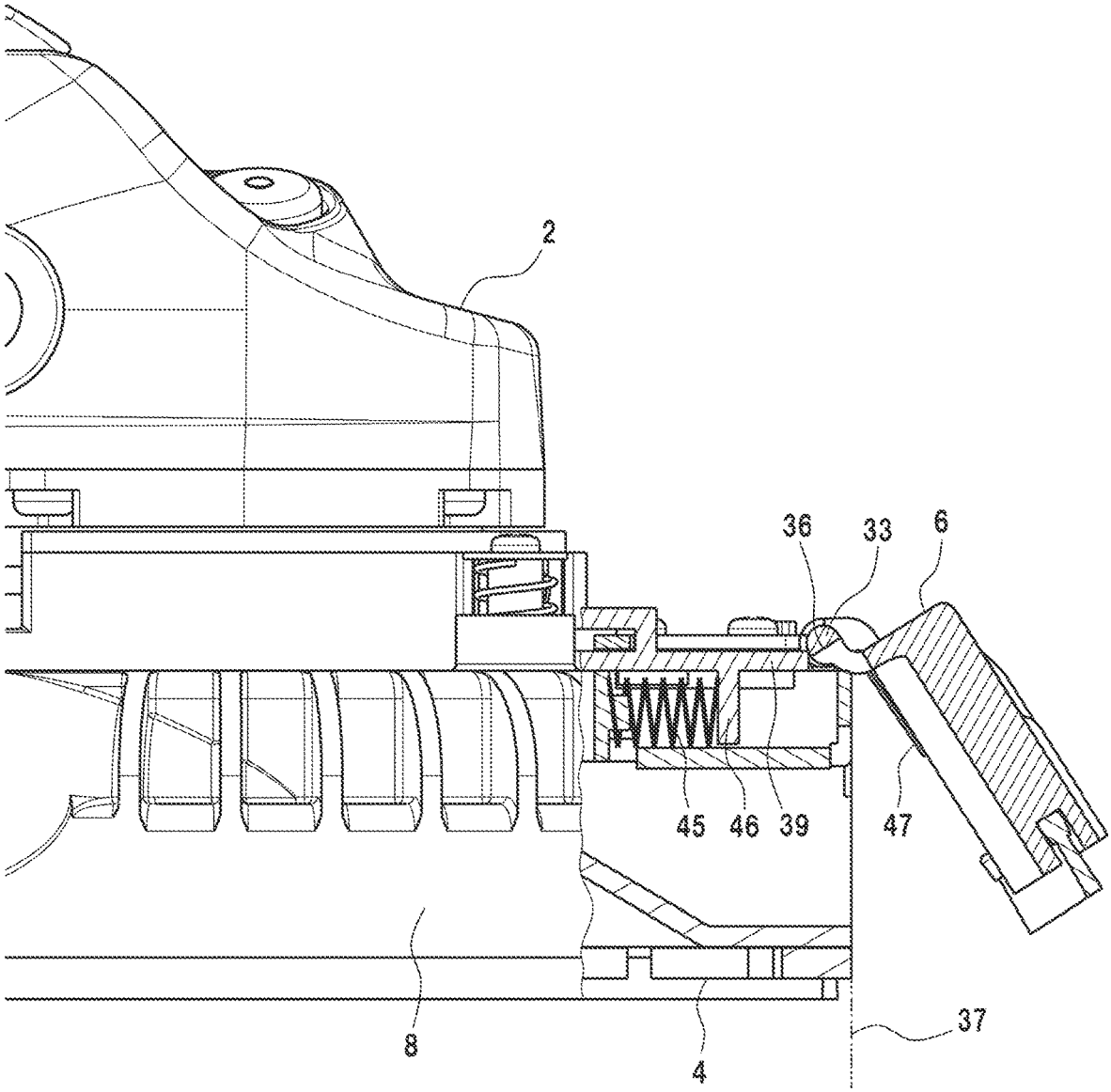
FIG. 6 is a side view including a partial sectional view showing the electric grinding machine equipped with a dust control function in a process of opening the window 6 according to the first embodiment of the present invention.

FIG. 6 is a side view including a partial sectional view showing the electric grinding machine equipped with a dust control function in a process of opening the window 6 according to the first embodiment of the present invention. As shown in FIG. 6, when the window 6 is closed manually again, the cylindrical portion 33 slides with the end of the slider 39 to stop the movement of the slider 39 again until the window completely closes. In other words, at this time, the end of the slider 39 does not move beyond the fitting surfaces 37 to protrude on the window 6 side. Therefore, the closing action of the window 6 will not be prohibited.

Then, once the window 6 is completely closed, the passage opening 35 is formed again. At this moment, the slider 39 moves towards the window 6 side by the action of the piston spring 45 to return to the state shown in FIG. 4, and tightly holds the window 6.

With the above-described configuration, according to the electric grinding machine equipped with a dust control function of the invention, without reducing the work efficiency, it is easy to switch between completely closing the window 6 for regular grinding work and opening the window 6 for grinding near a wall.

Figure 7:
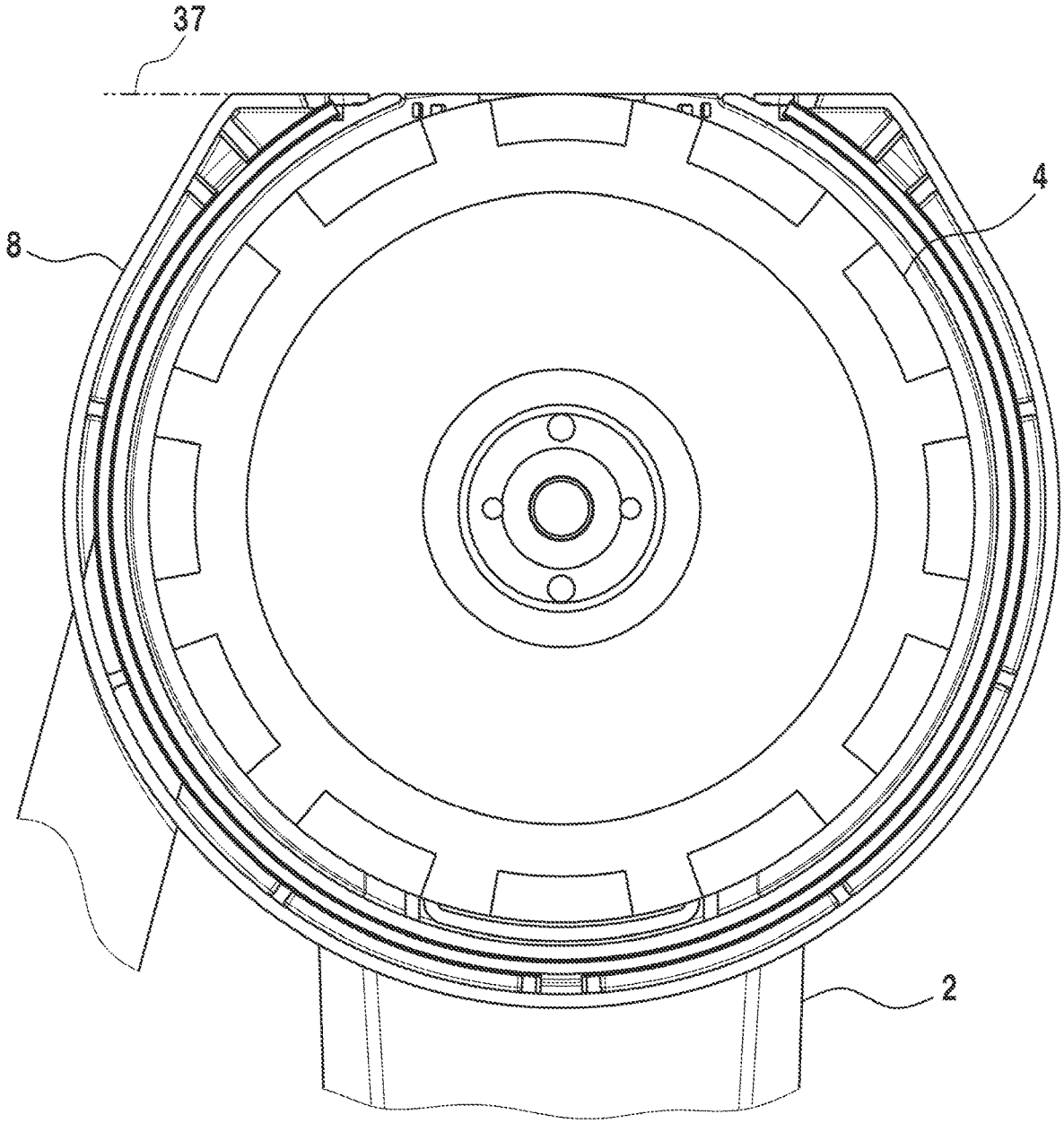
FIG. 7 is a bottom view showing the electric grinding machine equipped with a dust control function in the state when the window 6 is opened according to the first embodiment of the present invention.
Figure 8:
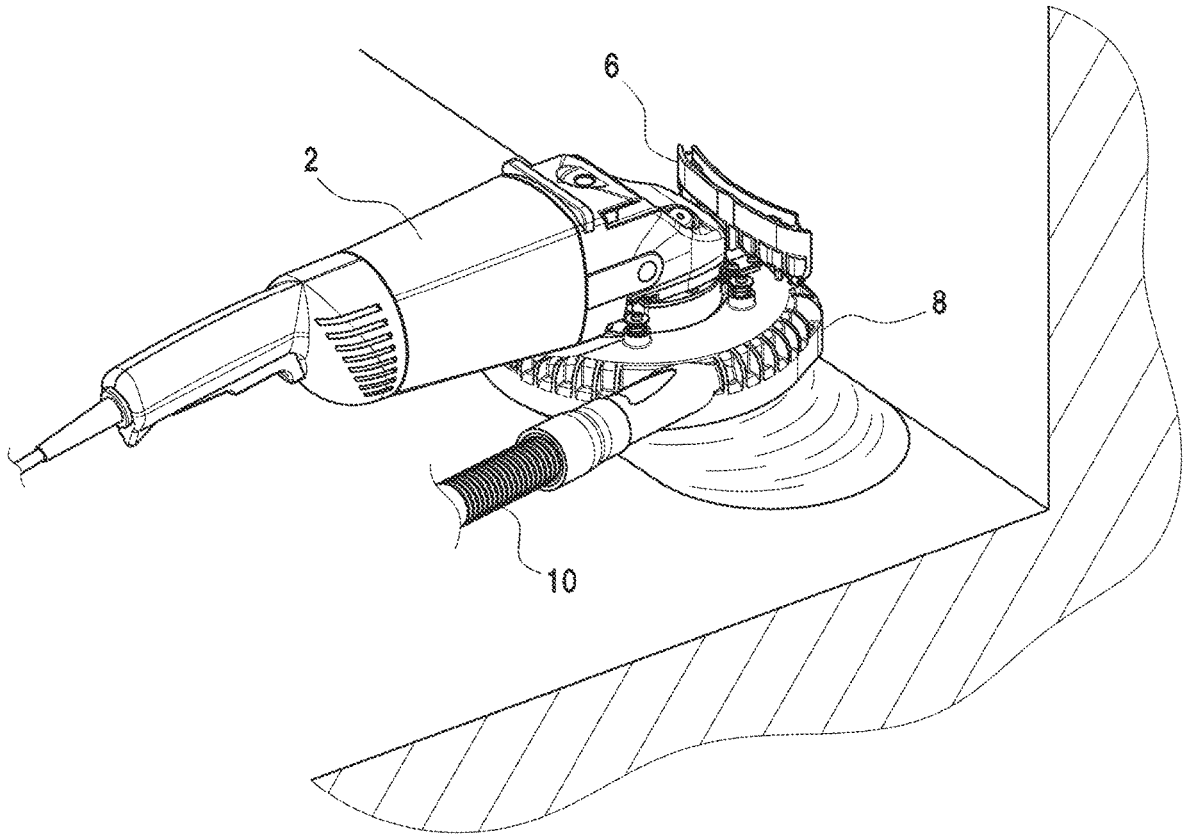
FIG. 8 is an illustrative view showing the electric grinding machine equipped with a dust control function when the electric grinding machine grinds near a wall according to the first embodiment of the present invention.

FIG. 7 is a bottom view showing the electric grinding machine equipped with a dust control function in the state when the window 6 is opened according to the first embodiment of the present invention. FIG. 8 is an illustrative view showing the electric grinding machine equipped with a dust control function when the electric grinding machine grinds near a wall according to the first embodiment of the present invention.

When the window 6 is open, as shown in FIG. 7, the fitting surfaces are set at the positions to contact with the outer circumference of the grinding disc. Therefore, as shown in FIG. 8, having the opening surface of the cover abut the wall and move the grinder to slide along the wall, it is achievable to grind near the wall.

Here, since rotational axes of the hinge mechanisms 7 are on the cover 8 side, as shown in FIG. 5, the window 6 moves closer to the cover 8 side than the fitting surfaces 37 and will not touch the wall. Therefore, without influence from the window 6, the opening surface of the cover 8 can securely and closely touch the wall. More specifically, even when grinding near the wall, the suctioning pressure inside the cover 8 will not significantly drop and dust can be substantially collected by the dust collector 10, similarly to during regular grinding.

Figure 9:
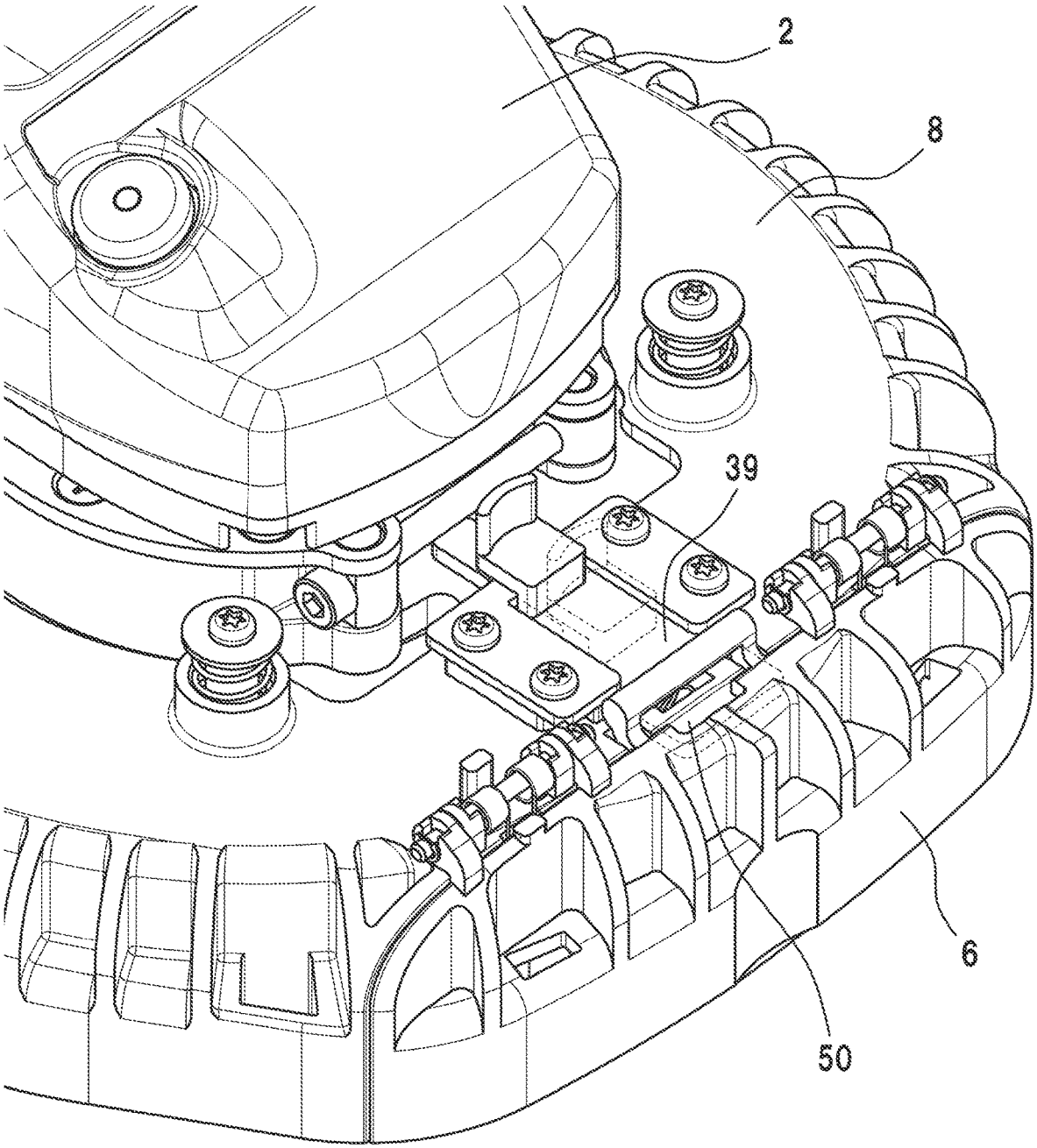
FIG. 9 is a perspective view showing an electric grinding machine equipped with a dust control function according to a second embodiment of the present invention.
Figure 10:
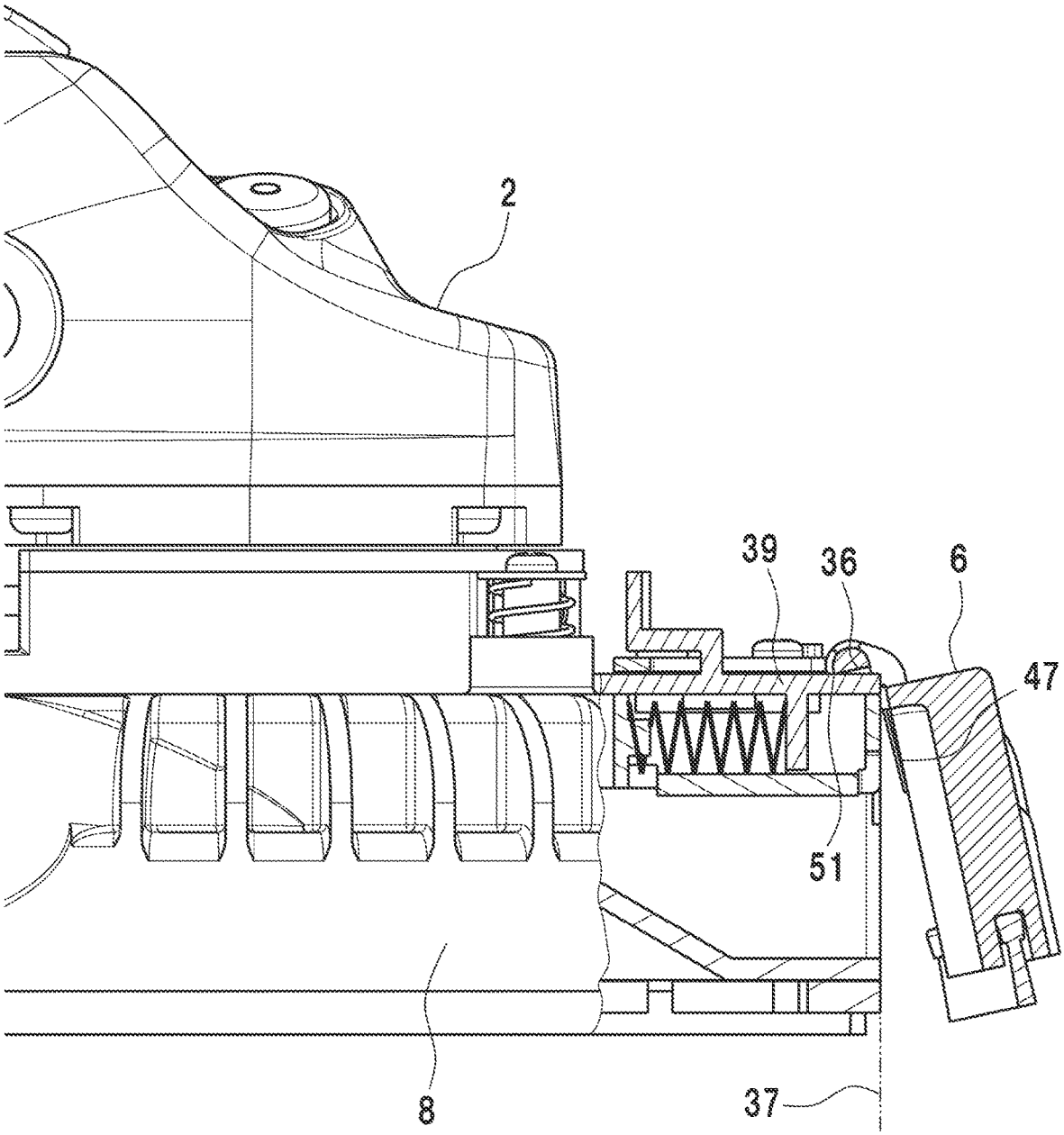
FIG. 10 is a side view including a partial sectional view showing the electric grinding machine equipped with a dust control function in a state when the window 6 is opened according to the second embodiment of the present invention.

Next, a second embodiment of the invention will be described. FIG. 9 is a perspective view showing an electric grinding machine equipped with a dust control function according to a second embodiment of the present invention. FIG. 10 is a side view including a partial sectional view showing the electric grinding machine equipped with a dust control function in a state when the window 6 is opened according to the second embodiment of the present invention In the first embodiment of the present invention, the electric grinding machine equipped with a dust control function has the above-described configuration. When the suctioning of the dust collector 10 is extremely strong, the suctioning the window 6 to the cover 8 side excels the energizing force of the torsion spring 47 even if the slider 39 is pulled, and the window 6 may not be opened.

For this reason, according to the second embodiment shown in FIG. 9, a vent 50 to connect to inside is provided to protrude from a part of the upper surface of the window 6. When the slider 39 is pulled, the vent 50 is exposed and weakens the suctioning force that suctions the window 6 onto the cover 8 side, whereby it is easier to open the window 6.

According to the second embodiment, when the window 6 is closed, the slider 39 returns to the position to cover the vent 50 again, so that it will not affect the dust collecting performance during grinding.

In addition, according to the electric grinding machine equipped with a dust collecting function having the above-described configuration, when the slider 39 is pulled to open the window 6, as shown in FIG. 10, once the end of the slider 39 moves beyond the fitting surfaces 37 to move towards the cover 8 side, the window 6 starts to open by the action of the torsion spring 47. Then, an end of the hollowed portion 36 presses the upper surface of the slider 39, which may result in adverse influence on the smooth motion of the slider 39.

Figure 11:
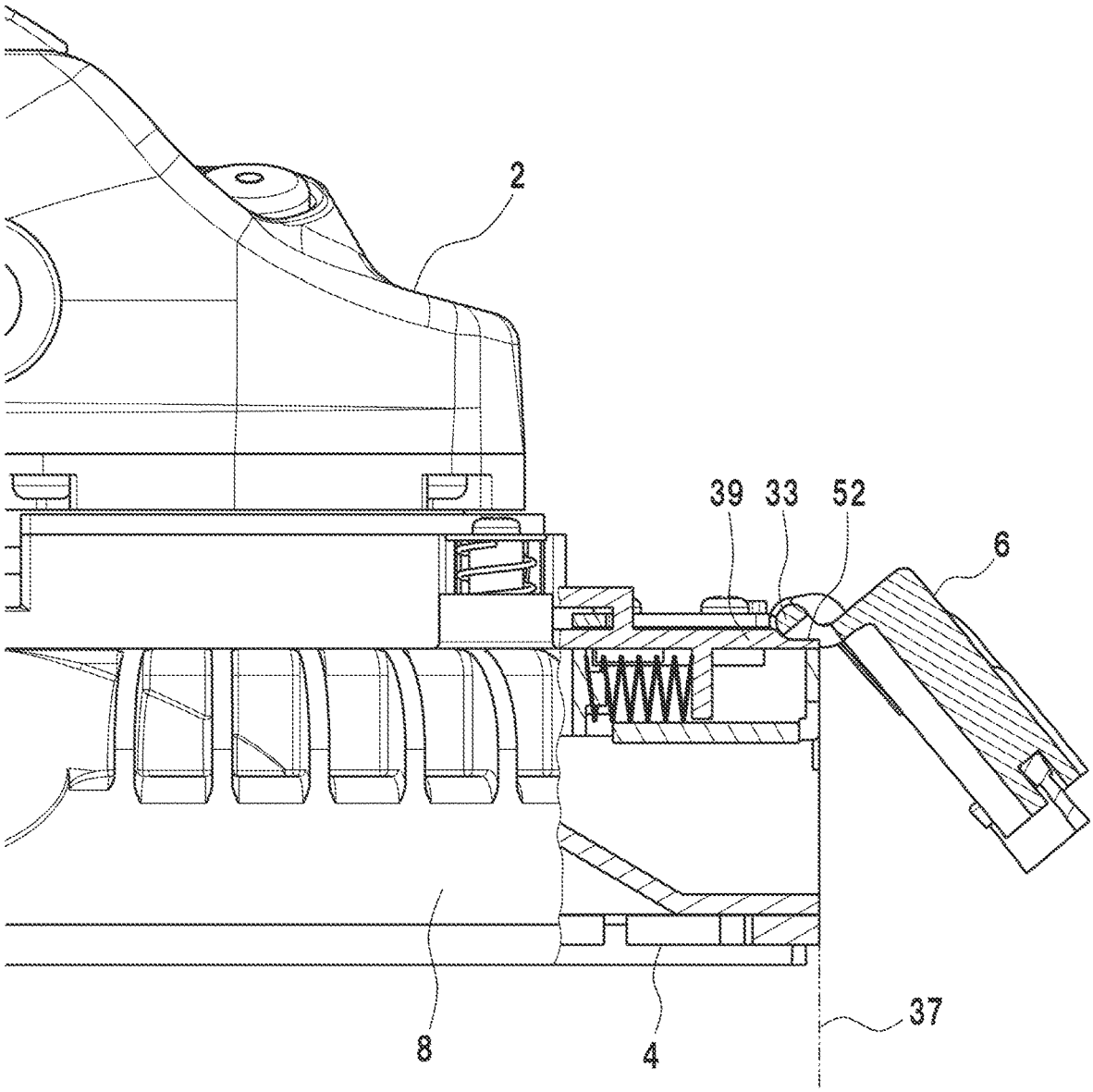
FIG. 11 is an illustrative view showing an electric grinding machine equipped with a dust control function according to a third embodiment of the invention.

FIG. 11 is an illustrative view showing an electric grinding machine equipped with a dust control function according to a third embodiment of the invention. For this reason, according to the third embodiment shown in FIG. 11, a part of the end of the slider 39 is formed with a thin plate 52, which can pass the gap between the upper surface of the cover 8 and the outer circumference of the cylindrical portion 33. The upper surface of the cover 8 and the upper surface of the slider 39 are concentric cylindrical surface to that of the cylindrical portion 33 when the end of the slider 39 matches the fitting surfaces 37.

According to the third embodiment, when the slider 39 is pulled, the end of the slider 39 goes beyond the fitting surfaces 37 and move to the cover 8 side, the cylindrical portion 33 can rotate. Therefore, as described above, the edge 51 will hardly press the slider 39, but makes it easy to operate the slider 39.

Here, as described above, in this embodiment, the upper surface of the slider 39 and the upper surface of the thin plate 52 are connected via a cylindrical surface. However, as long as the above function can be performed, this surface can be formed as a simple step-like shape.

In addition, according to the electric grinding machine equipped with a dust control function having the above-described configuration, in the actual configuration, in order to secure the movability of the slider 39, it is necessary to provide a small space between the bottom surface of the slider 39 and the upper surface of the window 6. As a result, even when the window 6 is closed, there may be slight gap between fitting surfaces of the cover 8 and the window 6.

Figure 12:
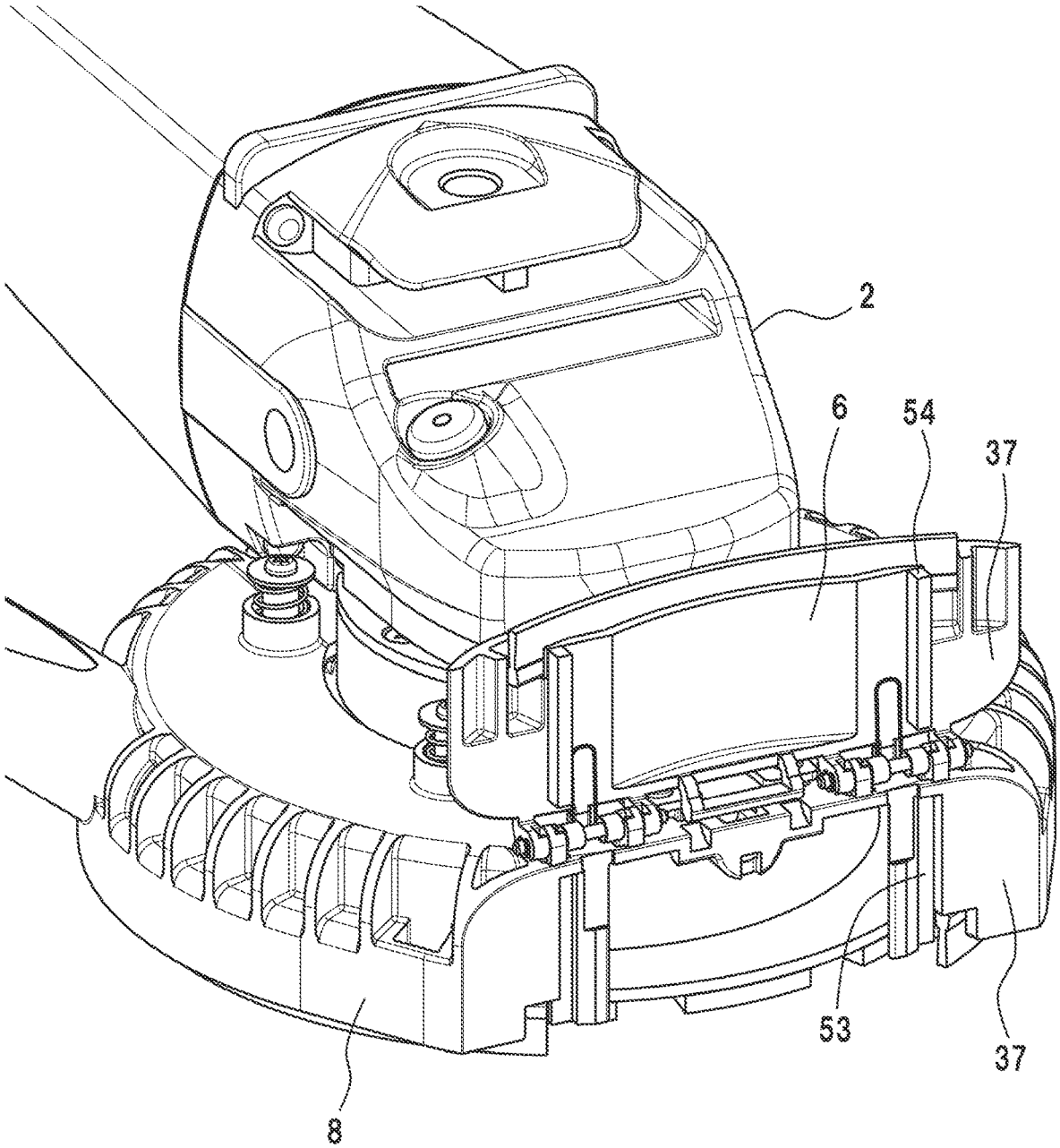
FIG. 12 is an illustrative view showing an electric grinding machine equipped with a dust control function in which a soft packing 54 is additionally disposed according to a fourth embodiment of the invention.

FIG. 12 is an illustrative view showing an electric grinding machine equipped with a dust control function in which a soft packing 54 is additionally disposed according to a fourth embodiment of the invention. For this reason, according to the fourth embodiment shown in FIG. 12, elongated grooves 53 are provided on a part of the fitting surfaces of the cover 8. The elongated grooves 53 penetrate from near the upper surface of the cover 8 to the bottom surface. In addition, on the fitting surfaces of the window 6, soft packings 54 are attached at the same positions as those of the elongated grooves 53. Each of the soft packings has the width and the length to fit in the elongated groove 53 and has the thickness that is twice the depth of the elongated grove 53.

According to the fourth embodiment, when the window 6 is closed, the slight gap is generated between the window 6 and the cover 8, but the gap is filled with the soft packings 54. Therefore, the air-tightness inside is enhanced and the dust collecting performance by the dust collector can be further improved.

Moreover, each of the soft packings 54 has a thickness not to protrude further than the fitting surfaces 37 and stay inward (not to protrude further than the cover 8) when the window 6 is opened. Therefore, in grinding near the wall as described above, the soft packings 54 will not peeled off therefrom by the friction against the wall.

Figure 13:
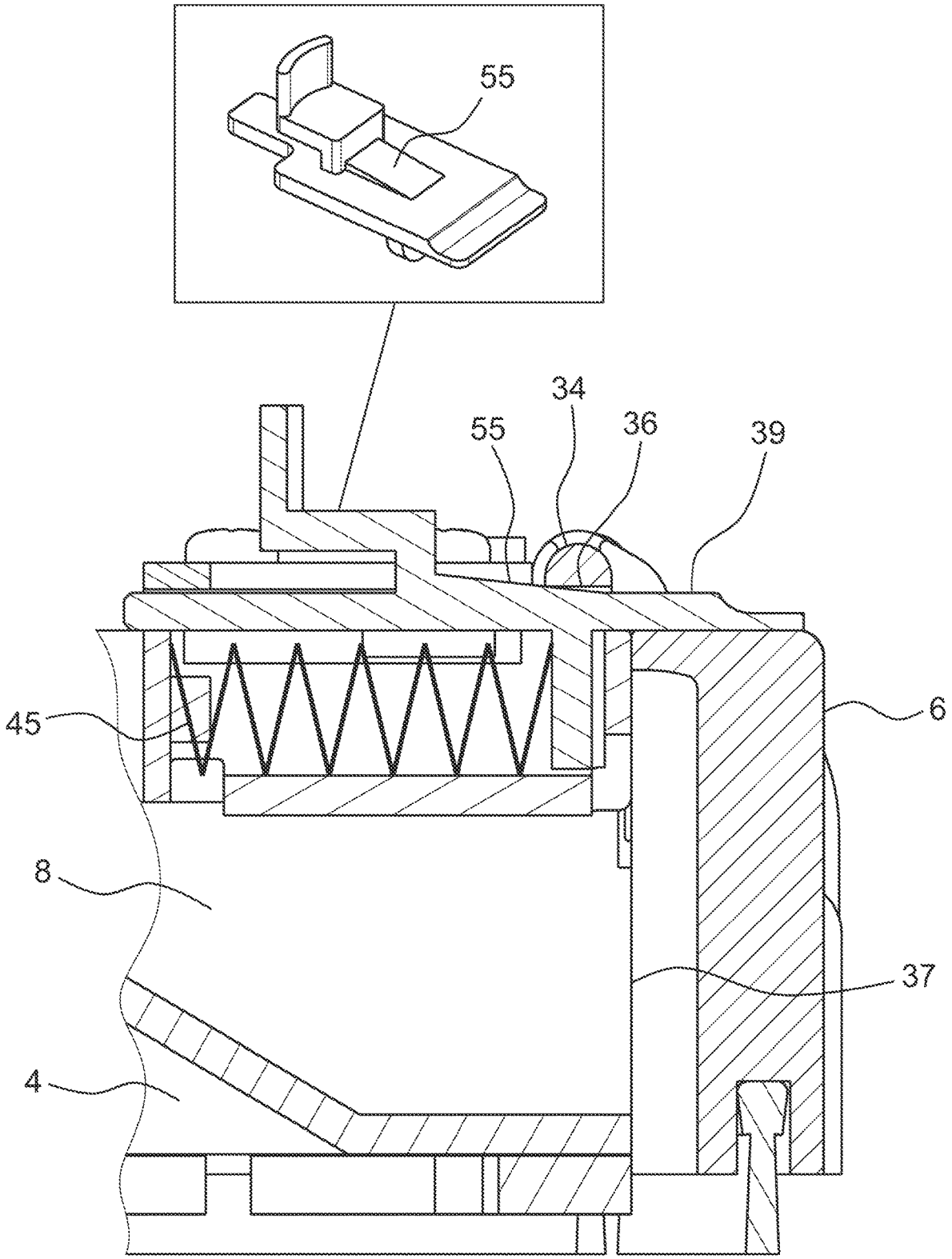
FIG. 13 is an illustrative view showing an electric grinding machine equipped with a dust control function in which a slope 55 is additionally disposed according to a fifth embodiment of the invention.

FIG. 13 is an illustrative view showing an electric grinding machine equipped with a dust control function in which a slope 55 is additionally disposed according to a fifth embodiment of the invention. Furthermore, according to the fifth embodiment of FIG. 13, there is provided a slope 55 on a part of the upper surface of the slider 39, which has greater thickness as it is closer to the flat projection 43.

According to the fifth embodiment, when the window 6 is manually closed and the slider 39 moves towards the window 6 side being urged by the piston spring 45, the slope 55 engages with an edge of the hollowed portion 36 of the gate 34 to stop the movement.

At this time, since the slope 55 is engaged with the gate 34, the window 6 will not open even if a hand is released from the flat projection 43. In other words, the gap generated with the fitting surfaces of the cover 8 can be minimized. Therefore, the air tightness inside the cover 8 can be enhanced, whereby the dust collecting performance of the dust collector 10 can be improved.

The disclosure of Japanese Patent Application No. 2018-217744, filed on Nov. 2, 2018, is incorporated in the application by reference.

While the present invention has been explained with reference to the specific embodiment of the present invention, the explanation is illustrative and the present invention is limited only by the appended claims.

What is claimed is:

1. An electric grinding machine comprising:

a spindle to be driven with a motor extending in a first direction;

a grinding disc attached to the spindle;

a cover covering the grinding disc;

a window disposed on the cover to expose a part of an outer circumference of the grinding disc;

a hinge mechanism extending in a second direction intersecting the first direction and joining the window to the cover so that the window freely moves between an opened position and a closed position; and a gate structure comprising:

a solid rod member which extends in the second direction and is concentric with a rotational axis of the hinge mechanism when the window is in the opened position and in the closed position; wherein the solid rod member comprises a planar longitudinal outer surface extending in the second direction and an outer circled circumferential surface extending in the second direction;

a passage opening which extends in the second direction and is formed by an upper surface of the cover and the planar longitudinal surface of the solid rod member, when the window is in the closed position;

a slider configured to pass through the passage opening in a third direction intersecting the second direction and the first direction, wherein the window moves to the opened position from the closed position when the slider passes through the passage opening from a side of the window to a side of the cover, and wherein the window moves to the closed position from the opened position when the slider passes through the passage opening from the side of the cover to the side of the window; and a coil spring urging the slider towards the window in the third direction.

2. The electric grinding machine according to claim 1, further comprising a torsion spring which is disposed around the rotational axis of the hinge mechanism and urges the window towards the opened position.

3. The electric grinding machine according to claim 1, wherein said window includes a vent to be covered with the slider when the slider passes through the passage opening in the third direction from the side of the cover to the side of the window so that the window is in the closed position.

4. The electric grinding machine according to claim 1, wherein said slider includes a thin plate portion at one distal end thereof which is closer to the window than the cover, and the thin plate portion is configured to pass through a gap formed by the upper surface of the cover and an outer circled circumferential surface of the solid rod member, when the window is in the opened position.

5. The electric grinding machine according to claim 1, wherein said cover includes a groove, and said window includes a packing to be fitted in the groove when the window is in the closed position.

6. The electric grinding machine according to claim 1, wherein said slider includes a slope portion at another distal end thereof which is closer to the cover than the window, and the slope portion has greater thickness at a portion which is closer to the cover than the window.

7. The electric grinding machine according to claim 1, wherein, when the window is in the closed position, the upper surface of the cover and the planar longitudinal surface of the solid rod member forms the passage opening, and wherein, when the window is in the closed position, the planar longitudinal surface of the solid rod member faces the slider.

8. The electric grinding machine according to claim 1, wherein, when the window is in the opened position, the upper surface of the cover and the outer circled circumferential surface of the solid rod member forms a gap, and wherein, when the window is in the opened position, the outer circled circumferential surface of the solid rod member faces the slider.

9. The electric grinding machine according to claim 1, wherein the slider comprises:

a thin plate portion at one distal end of the slider which is closer to the window than the cover;

a lever at another distal end of the slider which is closer to the cover than the window; and a main plate portion which has a thickness thicker than a thickness of the thin plate portion and is located between the thin plate portion and the lever.

10. The electric grinding machine according to claim 9, wherein the slider further comprises a slope portion which is located on the main plate portion.

11. The electric grinding machine according to claim 10, wherein the slope portion has greater thickness at a portion which is closer to the cover than the window.

12. The electric grinding machine according to claim 10, wherein the slider further comprises another slope portion which is located between the main plate portion and the thin plate portion.

13. The electric grinding machine according to claim 9, wherein, when the window is in the closed position, the upper surface of the cover and the planar longitudinal surface of the solid rod member forms the passage opening, and wherein, when the window is in the closed position, the planar longitudinal surface of the solid rod member faces the main plate portion of the slider.

14. The electric grinding machine according to claim 9, wherein, when the window is in the opened position, the upper surface of the cover and the outer circled circumferential surface of the solid rod member forms a gap, and wherein, when the window is in the opened position, the outer circled circumferential surface of the solid rod member faces the thin plate portion of the slider.

* * * * *